US007954566B2

(12) United States Patent
Yao

(10) Patent No.: US 7,954,566 B2
(45) Date of Patent: Jun. 7, 2011

(54) STABILIZER FOR DRILL STRINGS

(75) Inventor: Jing James Yao, Mississauga (CA)

(73) Assignee: Boart Longyear Global Holdco Inc., Salt Lake City, UT (US)

( * ) Notice: Subject to any disclaimer, the term of this patent is extended or adjusted under 35 U.S.C. 154(b) by 194 days.

(21) Appl. No.: 12/305,925

(22) PCT Filed: Jun. 22, 2007

(86) PCT No.: PCT/CA2007/001117

§ 371 (c)(1),
(2), (4) Date: Dec. 19, 2008

(87) PCT Pub. No.: WO2007/147257

PCT Pub. Date: Dec. 27, 2007

(65) Prior Publication Data

US 2010/0236829 A1 Sep. 23, 2010

(30) Foreign Application Priority Data

Jun. 22, 2006 (CA) ..... 2550801

(51) Int. Cl.
*E21B 17/10* (2006.01)
*E21B 17/22* (2006.01)

(52) U.S. Cl. ..... 175/325.2; 175/323; 175/325.5

(58) Field of Classification Search ..... 175/323, 175/325.2, 325.5, 325.1
See application file for complete search history.

(56) References Cited

U.S. PATENT DOCUMENTS

| | | | | |
|---|---|---|---|---|
| 1,583,262 A | | 5/1926 | Smith | |
| 3,642,079 A | | 2/1972 | Van Note | |
| 3,938,853 A | | 2/1976 | Jurgens et al. | |
| 3,945,446 A | | 3/1976 | Ostertag et al. | |
| 3,985,189 A | | 10/1976 | Jahnke et al. | |
| 4,844,179 A | * | 7/1989 | Forrest et al. | 175/92 |
| 5,553,676 A | * | 9/1996 | Self et al. | 175/19 |
| 6,681,875 B2 | | 1/2004 | Larsson et al. | |
| 2004/0050592 A1 | | 3/2004 | Carlstrom et al. | |

FOREIGN PATENT DOCUMENTS

| | | |
|---|---|---|
| CA | 2309942 | 11/2001 |
| WO | 87/03642 | 6/1987 |

OTHER PUBLICATIONS

CA 2550801, Apr. 3, 2008, Office Action.
PCT/CA2007/001117, Nov. 10, 2007, International Preliminary Report on Patentability.
AU 200726627, Apr. 20, 2010, Office Action.
AU 2007262627, Mail Date Sep. 3, 2010, Office Action.

* cited by examiner

*Primary Examiner* — Giovanna C Wright
(74) *Attorney, Agent, or Firm* — Workman Nydegger

(57) ABSTRACT

Apparatus and methods for using the drilling apparatus to increase the linear direction of the drilling action are described. The drilling apparatus contains a drill rod that is fitted with a reinforcing sleeve that is located on the drill rod as close as possible to the drill bit. The outer diameter of the sleeve is configured to be substantially the same as the bit diameter and, if necessary, just slightly smaller than the bit diameter. The sleeve reinforces the drill rod next to the drill bit and reduces and substantially eliminates the gap between the drill rod and the borehole in the vicinity of the drill bit. The sleeve, therefore, reduces the wobble of the drill bit in the borehole and reduces the drill bit from wavering from a straight linear drilling direction. The reinforcing sleeve can contain helical channels for moving material displaced by the drilling process away from the drill bit.

22 Claims, 5 Drawing Sheets

STABILIZER FOR DRILL STRINGS

CLAIM OF PRIORITY

This application claims priority of Canadian Application No. 2,550,801, filed on 24 Jun. 2006, the entire disclosure of which is incorporated herein by reference.

FIELD

This application relates generally to drilling equipment, as well as methods for using such apparatus in drilling operations. In particular, this application relates to percussive drilling apparatus, as well as methods for using such apparatus to increase the linear direction of a drilling action.

BACKGROUND

The process of percussive tunneling drilling in subterranean formations involves lifting a drill sting, which is tipped with a drill bit, into the desired location of the subterranean formation. During the drilling process, the drill string (and therefore the bit) is forced against the material of the subterranean formation to cut away the material. The drill bit is hammered repeatedly against the material of the subterranean formation, while sometimes being rotated. An example of conventional percussive drilling equipment is illustrated in FIG. 1 which shows a drill string containing a drill bit 1, an extension body 2, a first drill rod 3, a drill rod connector 4, and a second drill rod 5. The drill bit 1 is repeatedly hammered against the bottom of the borehole to cut away the material and thereby increase the depth of the borehole.

One of the problems encountered in percussive tunneling drilling is drilling in a straight line, i.e., keeping the borehole as straight as possible. The drill bit tends to deviate from a straight line because, as illustrated in FIG. 1, there exists a gap between the guide and the borehole wall. But this gap unfortunately allows the drill bit to wobble from the straight axis in which the drilling should occur, causing the bit to wander and the borehole to therefore not be straight, as shown in FIG. 1. This problem occurs less with larger drill rods, as opposed to smaller rods, because the strength provided by their larger size allows less wobble.

SUMMARY

This application relates to a drilling apparatus and methods for using the drilling apparatus to increase the linear direction of the drilling action. The drilling apparatus contains a drill rod that is fitted with a reinforcing sleeve that is located on the drill rod as close as possible to the drill bit. The outer diameter of the sleeve is configured to be substantially the same as the bit diameter and, if necessary, just slightly smaller than the bit diameter. The sleeve reinforces the drill rod next to the drill bit and reduces and substantially eliminates the gap between the drill rod and the borehole in the vicinity of the drill bit. The sleeve, therefore, reduces the wobble of the drill bit in the borehole and reduces the drill bit from wavering from a straight linear drilling direction. The reinforcing sleeve can contain helical channels for moving material displaced by the drilling process away from the drill bit.

BRIEF DESCRIPTION OF THE DRAWINGS

The following description can be better understood in light of the following Figures, in which.

Figure 1:
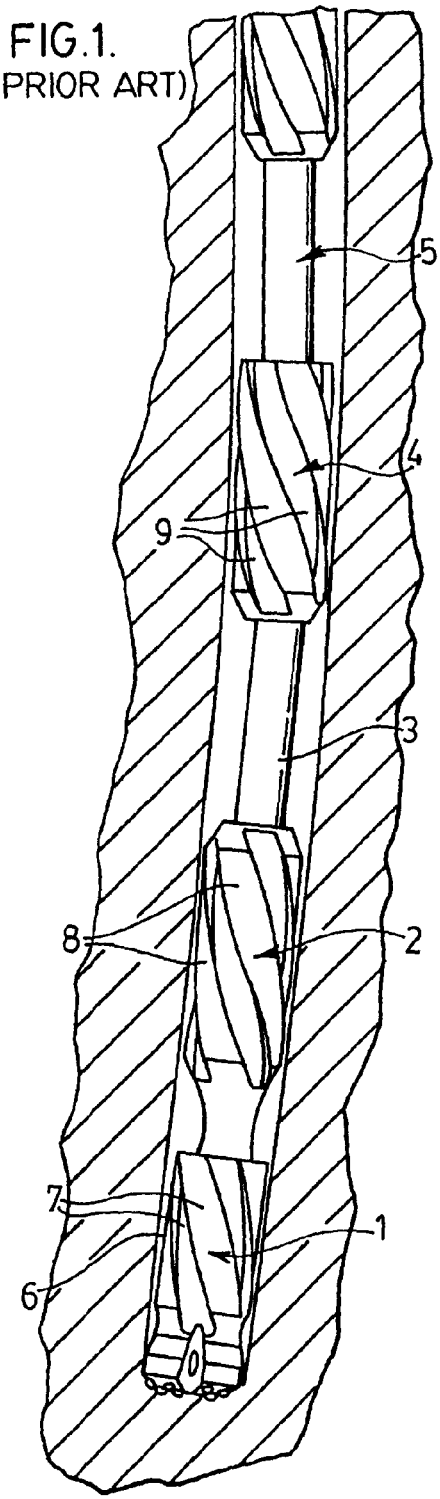
FIG.1. (PRIOR ART)
FIG. 1 depicts a prior art percussive drilling apparatus.

Together with the following description, the Figures demonstrate and explain the principles of the drilling apparatus and methods for using the apparatus. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus may be implemented and used without employing these specific details. Indeed, the apparatus and associated methods can be placed into practice by modifying the illustrated apparatus and associated methods and can be used in conjunction with any apparatus and techniques conventionally used in the industry. For example, while the description below focuses on percussive drilling for tunneling, this apparatus may be implemented in many other applications, such as with long-hole percussive drilling. Indeed, the apparatus could be used with any drilling equipment where the end of a drill rod needs to be stabilized and/or reinforced.

Figure 2:
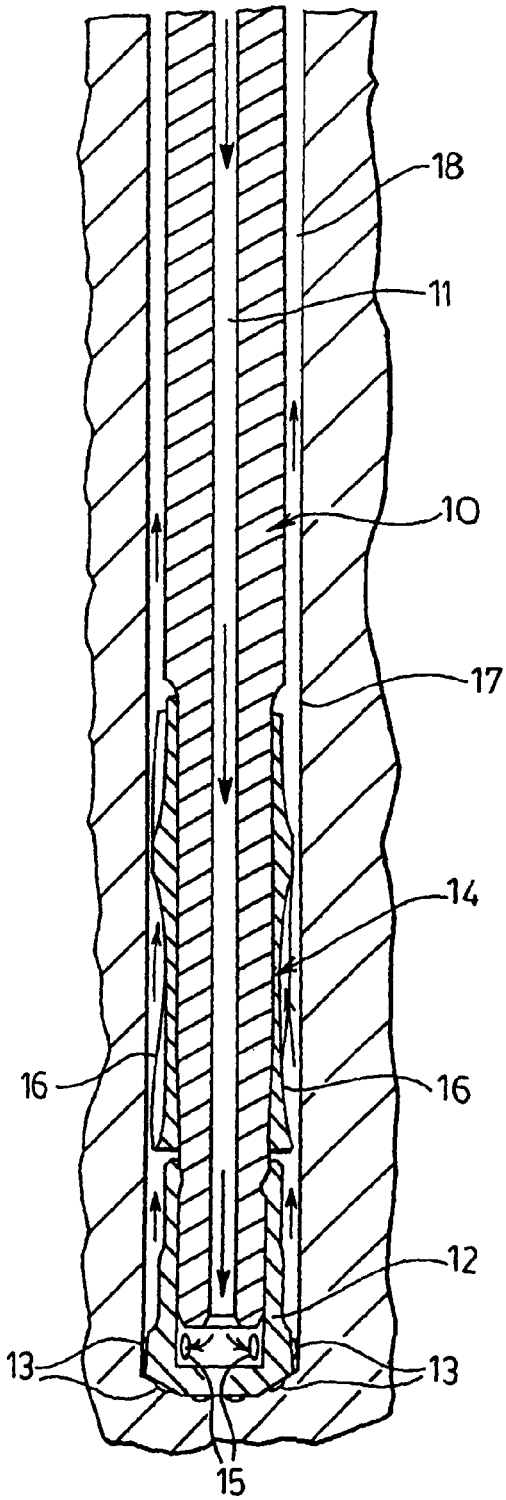
FIG. 2 illustrates a drilling apparatus containing a reinforcing sleeve.

FIG. 2 illustrates one example of the drilling apparatus and methods for using the drilling apparatus to increase the linear direction of the drilling action. FIG. 2 depicts a drill string (DS) that utilizes a drill rod 10 having a first end that is located proximate a drill bit 12. The opposite end (or distal end) of the drill rod is, as known in the art, connected to a shank adapter either directly through the internal thread of the rod or indirectly through a coupling. The drill rod contains a reinforcing sleeve 14 on an outer portion thereof.

The drill string with the drill bit 12 is used to drill through the material of the subsurface formation, thereby creating a borehole 18. The borehole 18 contains a wall 17 which, as described below, is located as close as possible to the outer surface of the reinforcing sleeve 14 so that any gap between their surfaces is minimized.

Figure 4:
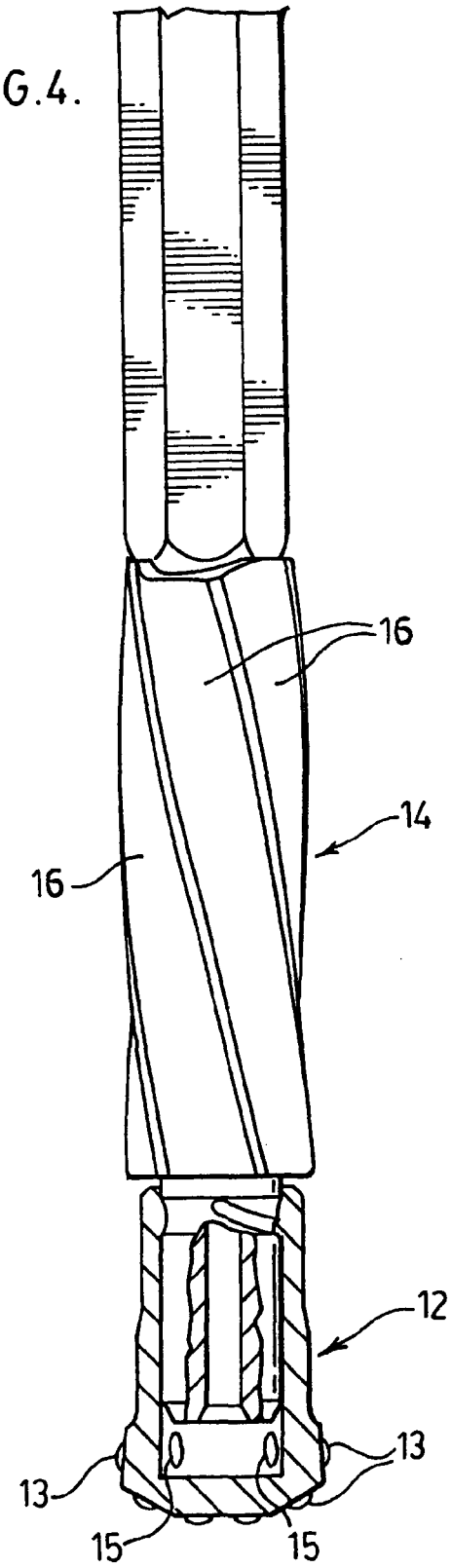
FIGS. 4 and 5 depict a drill rod containing a reinforcing sleeve that is connected to a drill bit.
Figures 5, 6:
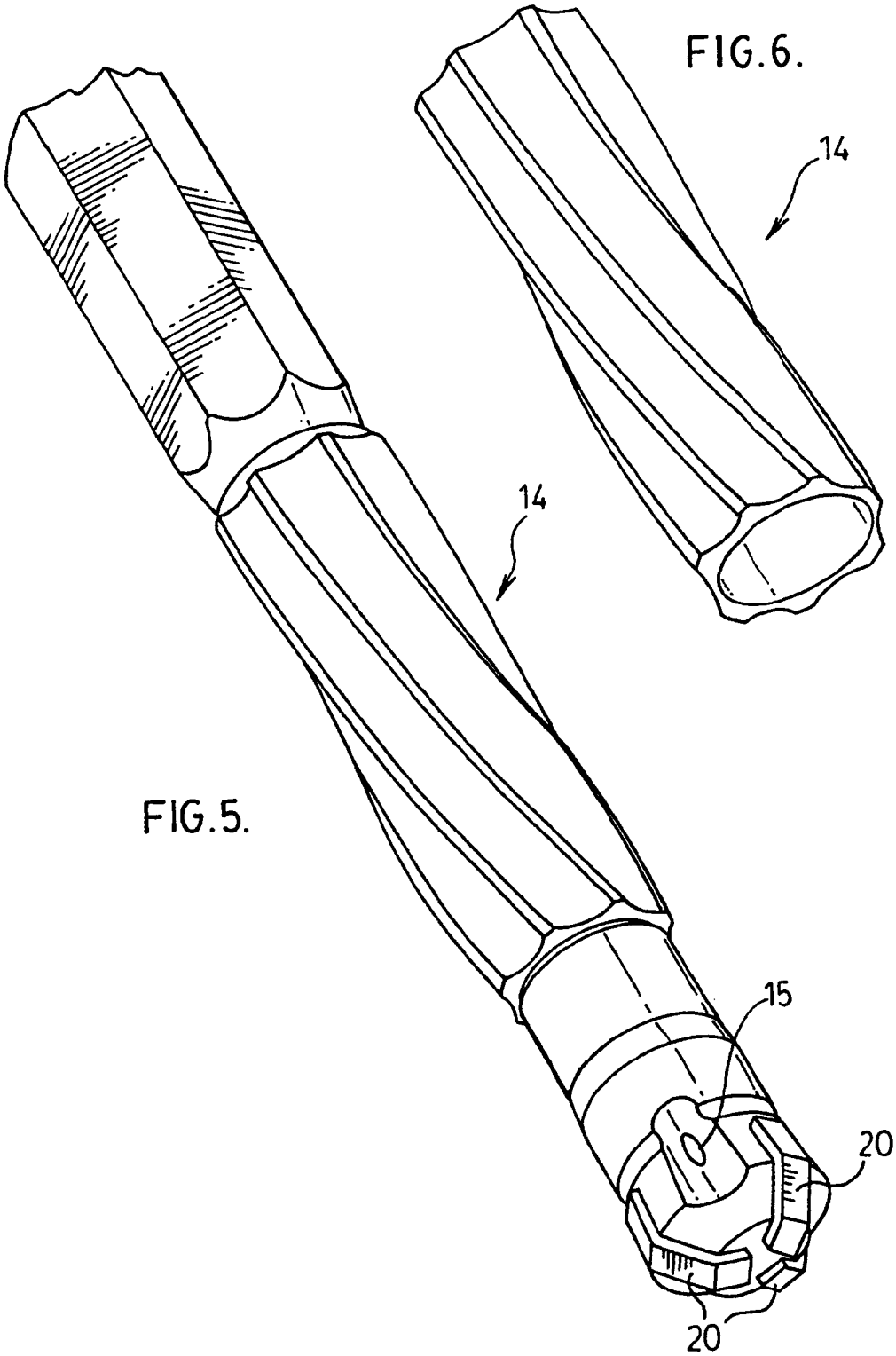
FIG. 6 contains a perspective view of the reinforcing sleeve.

The drill bit 12 can be any drill bit known in the art. In some embodiments, the drill bit 12 is a percussive drill bit as depicted in the Figures. In some instances, the percussive drill bit contains buttons 13 as the cutting element, as depicted in FIG. 4. In other instances, the cutting element of the drill bit contains blades 20, as depicted in FIG. 5. But the drill bit 12 could also be used drill bits containing other types of cutting elements.

Figure 3:
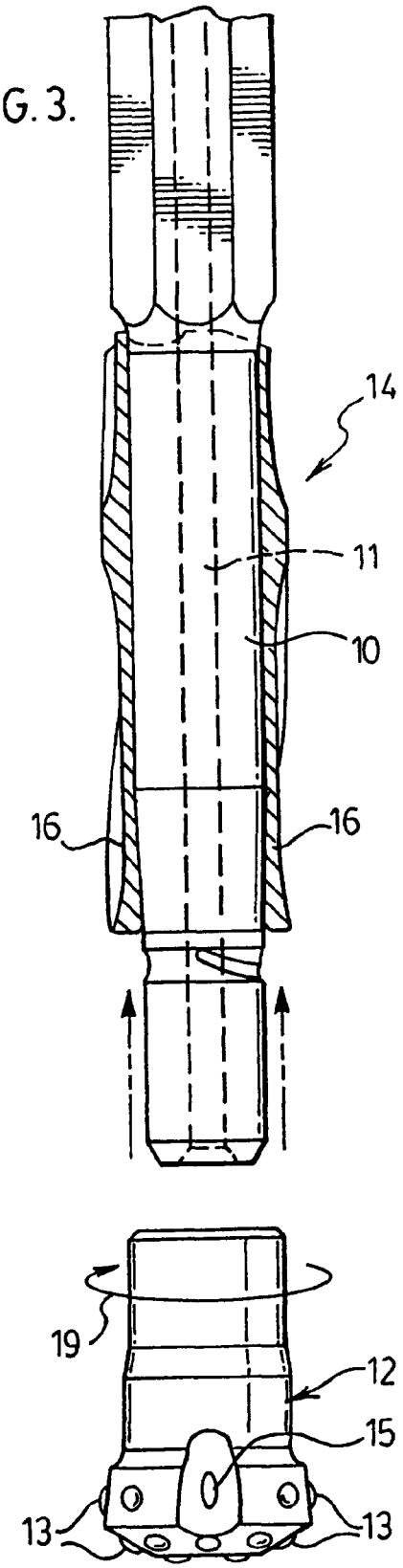
FIG. 3 shows a drill rod containing a reinforcing sleeve being connected to a drill bit.

The drill rod 10 is connected to the drill bit 12 using any mechanism known in the art. In some embodiments, the drill rod 10 and the drill bit 12 are configured with matching threads. Thus, the drill rod 10 and the drill bit 12 are merely threaded together, as shown in FIG. 3.

Figure 7:
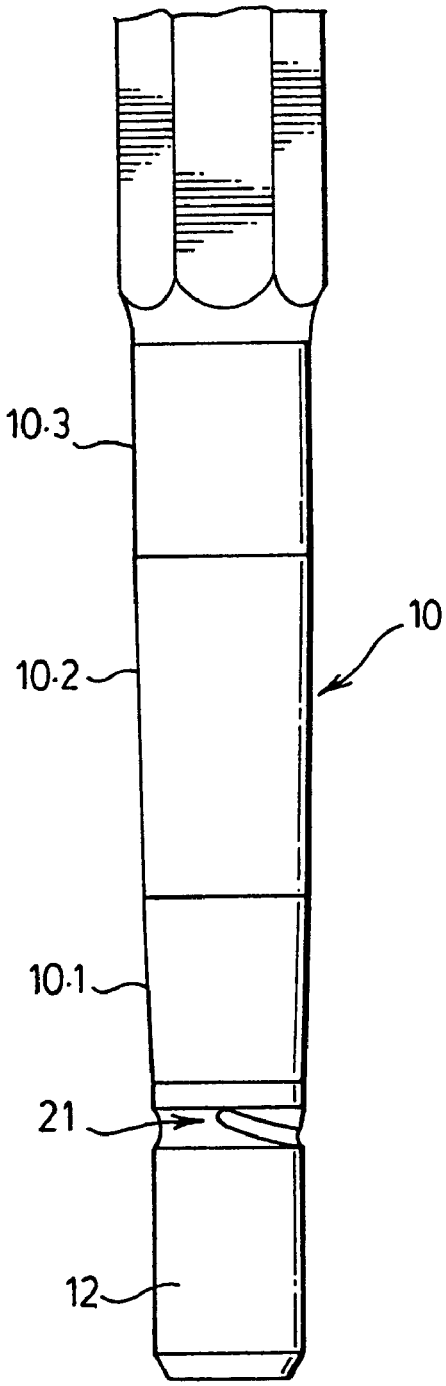
FIG. 7 depicts a drill rod prior to the attachment of the reinforcing sleeve.

The portion of the drill rod 10 containing the sleeve 14 is configured with an outer surface that substantially matches the inner surface of the reinforcing sleeve 14. In some embodiments, this portion is machined to provide a taper as illustrated in FIG. 7. As shown in this Figure, the drill rod 10 contains a contact portion 10.1 that is proximate the drill bit, a base portion 10.3 that is proximate the drill sting, and an extension portion 10.2 between the contact portion 10.1 and the base portion 10.3. In some embodiments, the drill rod 10 contains only these portions, as illustrated in FIG. 7, and the base portion 10.3 is adjacent the shank (or the coupling) in the drill string. In other embodiments, though, just one part of the drill rod (that is closest to the drill bit) contains these three portions and, therefore, there is a transition portion in the drill rod 10 between the base portion 10.3 and the adjacent drill rod in the drill string.

The contact portion 10.1 has a slightly trapezoidal shape with a shorter width (or diameter) closest to the drill bit 12 and a longer width closest to the extension portion 10.2. The extension portion 10.2 of the drill rod 10 contains a substantially constant diameter. The contact portion 10.3 also has a substantially constant diameter that is slightly greater than extension portion 10.2.

A reinforcing sleeve 14 is located on the drill rod 10. The sleeve 14 has a substantially cylindrical outer surface. The outer diameter of the sleeve 14 is substantially the same, but not greater than, the diameter of the bit 12. In other words, the outer diameter of the sleeve 14 can be configured to be as close as possible to—but without being larger than—the size of the bit. In some embodiments, the sleeve 14 can be configured so that the gap between the borehole wall 17 and the outer diameter of the sleeve is as minimal as possible.

Figure 8:
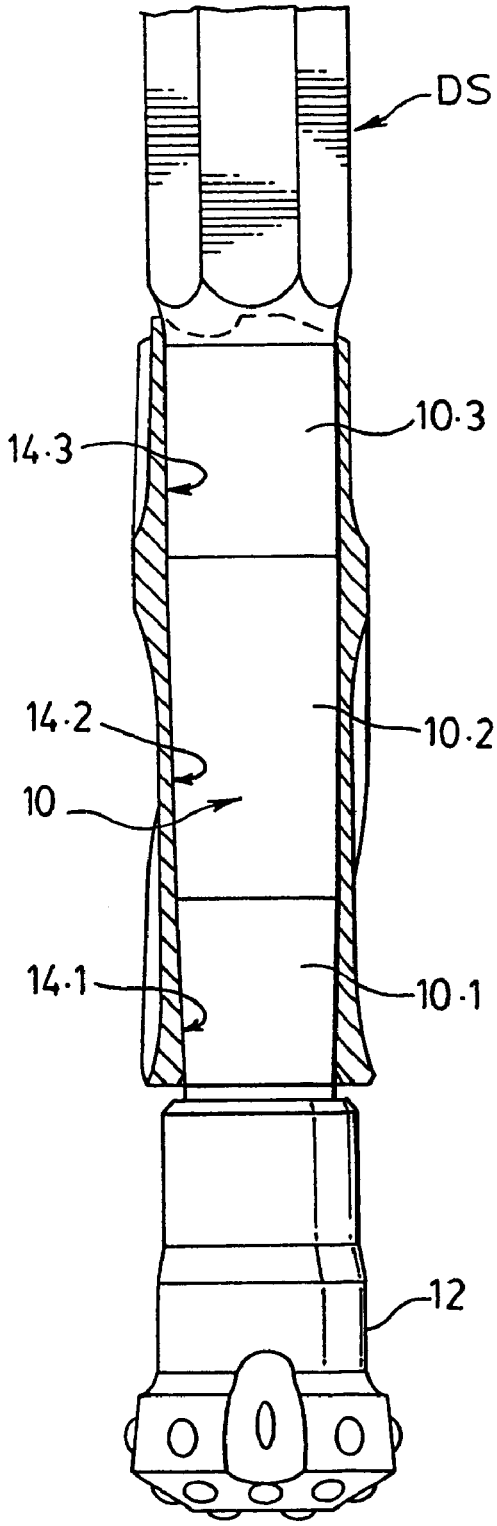
FIG. 8 shows a drill rod after a reinforcing sleeve has been attached.

The inner surface of the sleeve 14 is configured to substantially match the outer surface of the drill rod 10 on which it is attached. In the embodiments shown in FIG. 8, the interior of the sleeve 14 can be configured with a first section 14.1 having an inner diameter that substantially matches and fits over section 10.1 of the drill rod. With this arrangement, a taper fit can be provided and sleeve 14 can be prevented from moving along the drill rod away from the first end. As well, this configuration provides a means to accurately locate the sleeve 14 on the drill rod 10.

The second section 14.2 of the sleeve 14 has a substantially constant inner diameter that is just slightly larger than the outer diameter of extension portion 10.2. The length of the second section 14.2 is also substantially equal to the length of extension portion 10.2. Likewise, the third section 14.3 of the sleeve 14 has a substantially constant inner diameter that is just slightly smaller than the outer diameter of base portion 10.3 to provide an interference fit and the length of the third section 14.3 is substantially equal to the length of base portion 10.3. Thus, the length of the sleeve 14 is substantially the same as the length of the drill rod 10.

In the embodiments illustrated in the Figures, the drilling apparatus is configured to provide a fluid to the drill bit face where the cutting action occurs. Thus, the drill rod 10 is provided with a fluid passageway 11, as shown in FIG. 2. The drill bit 12 is also provided with flushing passages 15 that are in fluid communication with the drill rod passage 11. Thus, the drilling apparatus can deliver a flushing medium to the cutting face of the bit 12. This fluid helps remove the materials that have been displaced by the drilling action away from the drill bit and, in some embodiments, moves the material in the direction of the arrows depicted in FIG. 2.

To assist this material removal process, the outer surface of the sleeve 14 can be provided with external features. In some embodiments, these external features comprise a helical channel 16. The helical channel 16 can be shaped to provide volume to contain the material displaced during the drilling process and, in some embodiments, can be used to convey the displaced material along the length of the drill rod 10. The sleeve 12 can contain multiple helical channels 16 as depicted in the Figures or, in some embodiments, can only contain a single channel.

The helical channel(s) 16 wind helically up the sleeve from the bottom to the top. The helical channels 16 may have any rake angle that is able to move the displaced material from the bottom of the sleeve to the top. In some embodiments, the helical channels 16 may have a rake angle between about 0 to about 30 degrees.

The winding of the helical channel 16 can be any winding that allows the sleeve 14 to operate as described herein. And the channel(s) may have any width and depth that maximizes the amount of volume available for the displaced material. The ratio of the depth to the width of the helical channel 16 should be designed to accommodate the amount of displaced material that needs to be contained and moved in the axial direction of the drill rod 10.

In some instances, the helical channel 16 may extend along the whole length of the sleeve 14 as illustrated in the Figures. In other instances, though, the helical channel 16 does not extend the whole length of the sleeve 16. This latter configuration provides a portion of the sleeve 14 without the helical channel(s) 16 on the outer surface.

The reinforcing sleeve 14 braces the end of the drill rod 10 against bending and wandering from a substantially linear direction. Thus, the drill bit 12 experiences reduced wobble effects during the percussive drilling action. In some embodiments, the sleeve 14 can drill straight holes in otherwise difficult ground with no significant borehole deviation.

Sleeve 14 also isolates the portion of the drill bit proximate the drill rod 10 from contact with the borehole wall 17, reducing or precluding any wear thereof by the material being drilled though. Should the outer surface of the sleeve 14 (whose diameter is substantially equal to, or just slightly less than, the borehole wall 17) contact the borehole wall 17 and cause any slight wear, this wear would simply result in slightly reducing the depth of the helical channels 16.

Figure 9:
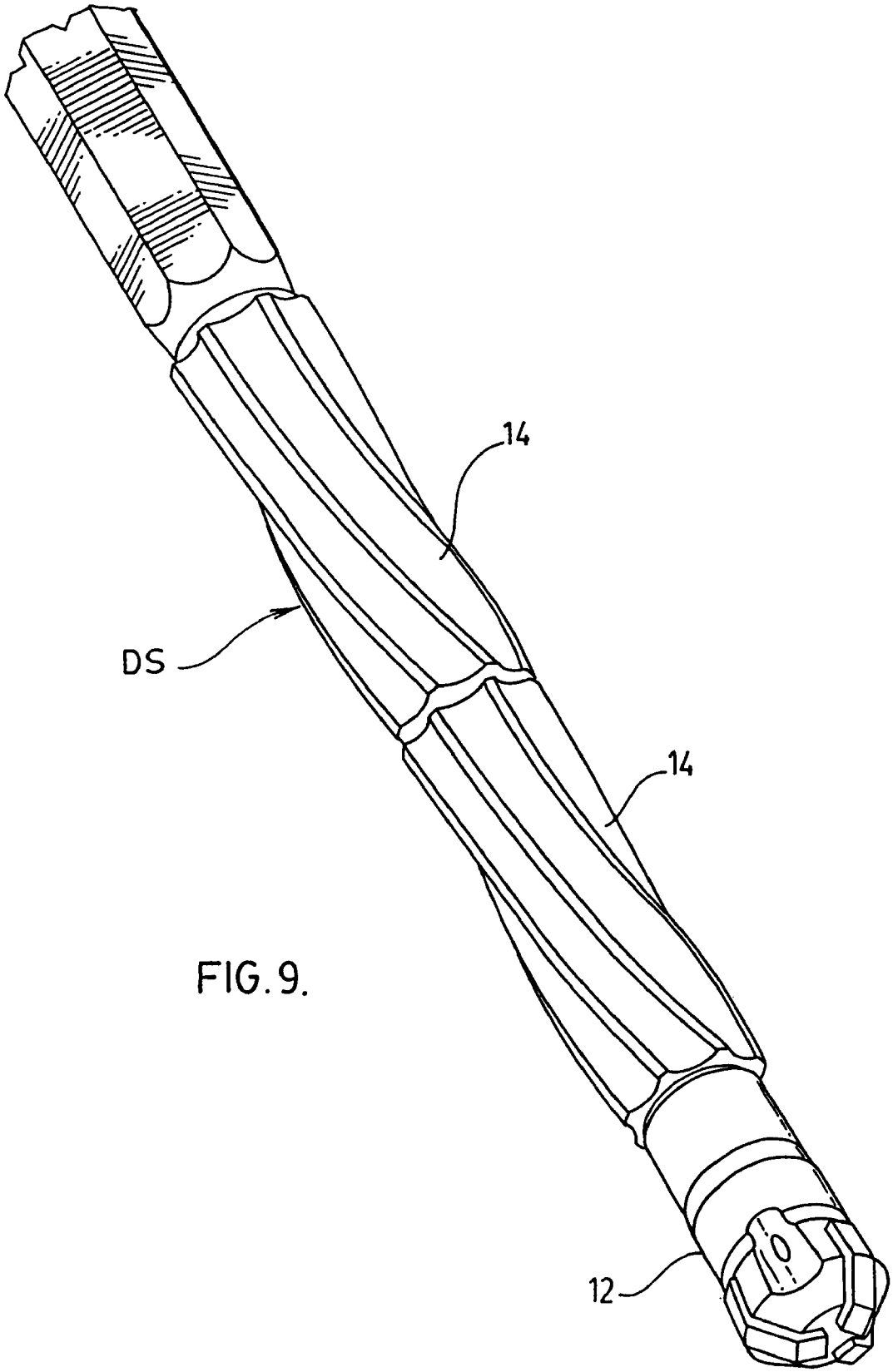
FIG. 9 illustrates a drill rod having two reinforcing sleeves.

Even if the drill string can contain multiple drill rods, the drill string may only need one or more reinforcing sleeves on the first rod. FIG. 9 illustrates a drill string wherein the drill string is provided with two reinforcing sleeves 14 on the first drill rod. The second sleeve in FIG. 9 adds further reinforcement of the drill string during the percussive drilling action. Thus, the second (and the third, fourth, etc.) guide that is typically used (as shown in FIG. 1) can then be omitted to lower the cost.

The reinforcing sleeve 14 can be made of any material, or combination of materials, that allows it to operate as described herein. Typically, the sleeve 14 is made of the same material(s) that the drill rods are made of.

The drilling apparatus described above can be manufactured using any known method that will provide the characteristics described above. After a drill rod is provided, a sleeve 14 is made by any known process. Then, the sleeve 14 is heated to a temperature of several hundred degrees which causes it to expand. The sleeve 14 is then slipped (if necessary, by force) onto the drill rod 10 until sleeve section 14.3 slides over base portion 10.3. At this point, sleeve section 14.2 is located over extension portion 10.2 and sleeve section 14.1 is located over contact portion 10.1. In its cold state, the sleeve could not be sleeved to the drill rod. But with sufficient heat to cause the sleeve to expand, it can be fed onto the end of the drill rod since no force is needed when it is shrink-fit onto the rod.

The sleeve 14 is then allowed to cool, which shrinks the sleeve 14 and affixes or attaches the sleeve to the drill rod and prevents movement of the sleeve over the rod. In some instances, the sleeve will bond with and become permanently attached to the drill rod. Thus, in these instances, the sleeve becomes part of the drill rod and will not be displaced by the rotational and impact forces in the percussive drilling process.

In other embodiments, the sleeve 14 need not be made separate from the drill rod and then slid over a conventional drill rod. In these embodiments, a drill rod is specifically manufactured using any known process to incorporate the features of the sleeve into the rod.

The drilling apparatus described above can be used in any known drilling process. The drill string containing the drill bit is hammered against the bottom of the borehole to cut away the material. When the cutting elements 13 or 20 of the drill bit 12 become worn, the drill string is retracted and a fresh sharp bit 12 is threaded on to the end of the drill rod 10. There is little worry of the sleeve becoming dislodged during this process because the bond between sleeve 14 and the drill rod 10 typically will withstand several tonnes of force without being dislodged.

In addition to any previously indicated modification, numerous other variations and alternative arrangements may be devised by those skilled in the art without departing from the spirit and scope of the invention, and appended claims are intended to cover such modifications and arrangements. Thus, while the invention has been described above with particularity and detail in connection with what is presently deemed to be the most practical and preferred aspects of the invention, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

I claim:

1. A drill string stabilizer, comprising:

a reinforcing sleeve having an inner surface and an outer surface; and at least one helical channel extending along the outer surface;

wherein the inner surface includes a first tapered section and a second section having a substantially uniform diameter, and wherein the first tapered section is threadless.

2. The drill string stabilizer of claim 1, wherein the at least one helical channel extends substantially the entire length of the reinforcing sleeve.

3. The drill string stabilizer of claim 2, wherein the outer surface of the reinforcing sleeve comprises a plurality of helical channels.

4. The drill string stabilizer of claim 2, wherein the at least one helical channel moves material displaced by a drilling action along the length of the reinforcing sleeve as it rotates during the drilling.

5. The drill string stabilizer of claim 2, wherein a rake angle of the at least one helical channel is about 30 degrees.

6. The drill string stabilizer of claim 1, wherein the at least one helical channel extends along only a portion of the length of the reinforcing sleeve.

7. A drill string stabilizer, comprising:

a reinforcing sleeve having an inner surface and an outer surface; and at least one helical channel extending along the outer surface;

wherein the inner surface includes a first tapered section and a second section having a substantially uniform diameter and wherein the inner surface of the reinforcing sleeve includes a third section having a substantially uniform diameter that is larger than the substantially uniform diameter of the second section.

8. A percussive drill string, comprising:

a drill rod including an outer surface, the outer surface having a tapered portion and a second portion of substantially uniform diameter; and a reinforcing sleeve having an inner surface that includes a first tapered section and a second section having a substantially uniform diameter, the reinforcing sleeve being contained on the tapered portion and the second portion of the drill rod, wherein the outer diameter of the reinforcing sleeve is substantially the same or slightly smaller than a drill bit configured to be secured to an end of the drill rod.

9. The drill string of claim 8, wherein the inner surface of the sleeve is configured to substantially match the outer surface of the tapered portion so that the sleeve is not displaced when the drill rod moves.

10. The drill string of claim 8, wherein the outer surface of the reinforcing sleeve comprises at least one helical channel.

11. The drill string of claim 10, wherein the at least one helical channel moves material displaced by a drilling action along the length of the drill rod as it rotates during the drilling.

12. The drill string of claim 10, wherein a rake angle of the at least one helical channel can range up to about 30 degrees.

13. The drill string of claim 8, wherein a plurality of reinforcing sleeves are contained on the drill rod.

14. A method for making a percussive drill string, the method comprising:

providing a drill rod containing a tapered portion and a second portion of substantially uniform diameter;

providing a tapered section of an inner surface of a reinforcing sleeve on the tapered portion of the drill rod and providing a second section of the inner surface of the reinforcing sleeve on the second portion of the drill rod, the second section of the inner surface of the reinforcing sleeve having a substantially uniform diameter, wherein an outer diameter of the reinforcing sleeve is substantially the same size or slightly smaller than a drill bit configured to be secured to an end of the drill rod and the outer surface of the reinforcing sleeve comprising helical channels.

15. The method of claim 14, further comprising heating the reinforcing sleeve, forcing the reinforcing sleeve over the drill rod, and then cooling the reinforcing sleeve to attach the reinforcing sleeve to the drill rod.

16. The method of claim 15, wherein the reinforcing sleeve bonds to the drill rod during the cooling process.

17. A percussive drilling apparatus, comprising:

a percussive drill bit;

a drill string containing a drill rod with a tapered portion that is connected to the drill bit; and a reinforcing sleeve contained on the tapered portion of the drill rod, an inner surface of the reinforcing sleeve including a tapered section and a second section having a substantially uniform diameter, the outer diameter of the sleeve being substantially the same or slightly smaller than the drill bit, and the outer surface of the reinforcing sleeve comprising a helical channel.

18. The drilling apparatus of claim 17, wherein the inner surface of the sleeve is configured to substantially match the outer surface of the tapered portion so that the sleeve is not displaced when the drill rod moves.

19. The drilling apparatus of claim 17, wherein the helical channel moves material displaced by a drilling action along the length of the drill rod as it rotates during the drilling.

20. The drilling apparatus of claim 17, wherein the reinforcing sleeve is positioned adjacent the drill bit.

21. A method for percussive drilling, comprising:

providing a percussive drilling apparatus containing a drill bit, a drill string containing a drill rod and a reinforcing sleeve, the drill rod having a tapered portion that is connected to the drill bit, the reinforcing sleeve having an inner surface with a tapered section, the tapered section of the reinforcing sleeve being contained on the tapered portion of the drill rod, the inner surface of the reinforcing sleeve further including a second section having a substantially uniform diameter, wherein the outer diameter of the sleeve is substantially the same or slightly smaller than the diameter of the drill bit and the outer surface of the reinforcing sleeve comprising a helical channel; and repeatedly forcing the drill bit against a material to be drilled.

22. The method of claim 21, further comprising rotating the drilling apparatus so that the material displaced by the drilling action moves along the length of the drill rod as it rotates.

* * * * *

UNITED STATES PATENT AND TRADEMARK OFFICE

CERTIFICATE OF CORRECTION

PATENT NO. : 7,954,566 B2
APPLICATION NO. : 12/305925
DATED : June 7, 2011
INVENTOR(S) : Yao It is certified that error appears in the above-identified patent and that said Letters Patent is hereby corrected as shown below:

Column 3
Line 5, change "drill sting" to --drill string--

Signed and Sealed this
Twentieth Day of December, 2011

David J. Kappos
*Director of the United States Patent and Trademark Office*